US009745848B2

(12) United States Patent
Rowe et al.

(10) Patent No.: US 9,745,848 B2
(45) Date of Patent: Aug. 29, 2017

(54) DRILLING FLUID ANALYSIS USING TIME-OF-FLIGHT MASS SPECTROMETRY

(71) Applicant: Halliburton Energy Services, Inc., Houston, TX (US)

(72) Inventors: Mathew D. Rowe, Lafayette, LA (US); David Muirhead, Scotland (GB)

(73) Assignee: Halliburton Energy Services, Inc., Houston, TX (US)

( * ) Notice: Subject to any disclaimer, the term of this patent is extended or adjusted under 35 U.S.C. 154(b) by 83 days.

(21) Appl. No.: 14/432,137

(22) PCT Filed: Aug. 22, 2013

(86) PCT No.: PCT/US2013/056297

§ 371 (c)(1),
(2) Date: Mar. 27, 2015

(87) PCT Pub. No.: WO2015/026361

PCT Pub. Date: Feb. 26, 2015

(65) Prior Publication Data

US 2015/0260035 A1 Sep. 17, 2015

(51) Int. Cl.
*E21B 49/00* (2006.01)
*E21B 21/01* (2006.01)
(Continued)

(52) U.S. Cl.
CPC ..... *E21B 49/005* (2013.01); *E21B 21/01* (2013.01); *E21B 21/067* (2013.01); *E21B 49/00* (2013.01);
(Continued)

(58) Field of Classification Search
CPC ..... E21B 21/01; E21B 21/067; E21B 49/00; E21B 49/005; E21B 49/086; H01J 49/0027; H01J 49/26; H01J 49/40
See application file for complete search history.

(56) References Cited

U.S. PATENT DOCUMENTS 4,635,735 A 1/1987 Crownover
4,833,915 A 5/1989 Radd et al.
(Continued)

FOREIGN PATENT DOCUMENTS

FR 2774768 A1 8/1999
GB 2491443 A 12/2012
(Continued)

OTHER PUBLICATIONS

International Search Report and Written Opinion issued in related PCT Application No. PCT/US2013/056297 mailed May 14, 2014, 16 pages.
(Continued)

*Primary Examiner* — Mark R Gaworecki
(74) *Attorney, Agent, or Firm* — John W. Wustenberg; Baker Botts L.L.P.

(57) ABSTRACT

An example method for analyzing drilling fluid used in a drilling operation within a subterranean formation may comprise placing a TOF-MS in fluid communication with a drilling fluid. The drilling fluid may be flowing through a fluid conduit coupled to a drilling assembly. A chemical composition of the drilling fluid may be determined using the TOF-MS. And a formation characteristic may be determined using the determined chemical composition.

18 Claims, 6 Drawing Sheets

(51) Int. Cl.

| | |
|---|---|
| ***H01J 49/40*** | (2006.01) |
| ***H01J 49/00*** | (2006.01) |
| ***H01J 49/26*** | (2006.01) |
| ***E21B 21/06*** | (2006.01) |
| ***E21B 49/08*** | (2006.01) |

(52) U.S. Cl.
CPC ..... *E21B 49/086* (2013.01); *H01J 49/0027* (2013.01); *H01J 49/26* (2013.01); *H01J 49/40* (2013.01)

(56) References Cited

U.S. PATENT DOCUMENTS

| | | | | |
|---|---|---|---|---|
| 6,661,000 | B2 | 12/2003 | Smith et al. | |
| 6,670,605 | B1 | 12/2003 | Storm, Jr. et al. | |
| 7,189,967 | B1 * | 3/2007 | Whitehouse ..... | H01J 49/063 250/292 |
| 7,219,541 | B2 | 5/2007 | DiFoggio | |
| 7,395,691 | B2 | 7/2008 | Sterner et al. | |
| 7,944,211 | B2 | 5/2011 | Smits | |
| 8,013,295 | B2 | 9/2011 | Zhdaneev et al. | |
| 8,056,408 | B2 | 11/2011 | Pop et al. | |
| 8,145,429 | B2 | 3/2012 | DiFoggio et al. | |
| 2004/0026125 | A1 | 2/2004 | Meister et al. | |
| 2007/0169540 | A1 | 7/2007 | Sterner et al. | |
| 2010/0089120 | A1 | 4/2010 | Hanson | |
| 2010/0181471 | A1 | 7/2010 | Pop et al. | |
| 2012/0205534 | A1 * | 8/2012 | Hunter ..... | H01J 49/0013 250/282 |
| 2012/0267525 | A1 | 10/2012 | Sasai et al. | |
| 2013/0087698 | A1 | 4/2013 | Pomerantz et al. | |
| 2013/0192360 | A1 | 8/2013 | Jamison et al. | |

FOREIGN PATENT DOCUMENTS

| | | | |
|---|---|---|---|
| NO | 302978 | A | 12/1991 |
| NO | 302978 | B1 | 5/1998 |
| WO | 2012-112154 | A1 | 8/2012 |

OTHER PUBLICATIONS

Ramaswami, S. et al., "Integration of Advanced Mud Gas Logs, Petrophysical Logs and Formation Testing for Fluid Typing—A Middle East Case Study", SPWLA-2012-052, presented at the SPWLA 53rd Annual Logging Symposium, Jun. 16-20, 2012, Cartagena, Colombia, 16 pages.

Hall, Don J. et al., "Analysis of Borehole Gas With Direct Quadrupole Mass Spectrometry" presented at the AAPG Hedberg Conference, Jun. 8-11, 2010, Vail, Colorado, 4 pages.

Warren, Bruce et al., "Application of DQMS in an Oil Producing Fractured Carbonate System", adapted from a presentation a AAPG Southwest Section Meeting, May 19-22, 2012, Ft. Worth, Texas, 5 pages.

International Preliminary Report on Patentability issued in related PCT Application No. PCT/US2013/056297 mailed Mar. 3, 2016, 11 pages.

International Search Report and Written Opinion issued in related PCT Application No. PCT/US2014/021114 mailed Jul. 18, 2014, 14 pages.

* cited by examiner

DRILLING FLUID ANALYSIS USING TIME-OF-FLIGHT MASS SPECTROMETRY

CROSS-REFERENCE TO RELATED APPLICATION

The present application is a U.S. National Stage Application of International Application No. PCT/US2013/056297 filed Aug. 22, 2013, which is incorporated herein by reference in its entirety for all purposes.

BACKGROUND

The present disclosure relates generally to well drilling operations and, more particularly, to drilling fluid analysis using Time-of-Flight Mass Spectrometry.

During the drilling of subterranean wells, a fluid is typically circulated through a fluid circulation system comprising a drilling rig and fluid treatment/storage equipment located substantially at or near the surface of the well. The fluid is pumped by a fluid pump through the interior passage of a drill string, through a drill bit and back to the surface through the annulus between the well bore and the drill string. As the well is drilled, gasses from the formation may be released and captured in the fluid as it is circulated. In some instances, the gas may be wholly or partially extracted from the fluid for analysis. The gas analysis may be used to determine characteristics about the formation. The sensitivity and speed of the gas analysis may affect the accuracy and reliability of the analysis data and, therefore, the accuracy of the formation characteristics determined using the analysis data.

FIGURES

Some specific exemplary embodiments of the disclosure may be understood by referring, in part, to the following description and the accompanying drawings.

Figure 1:
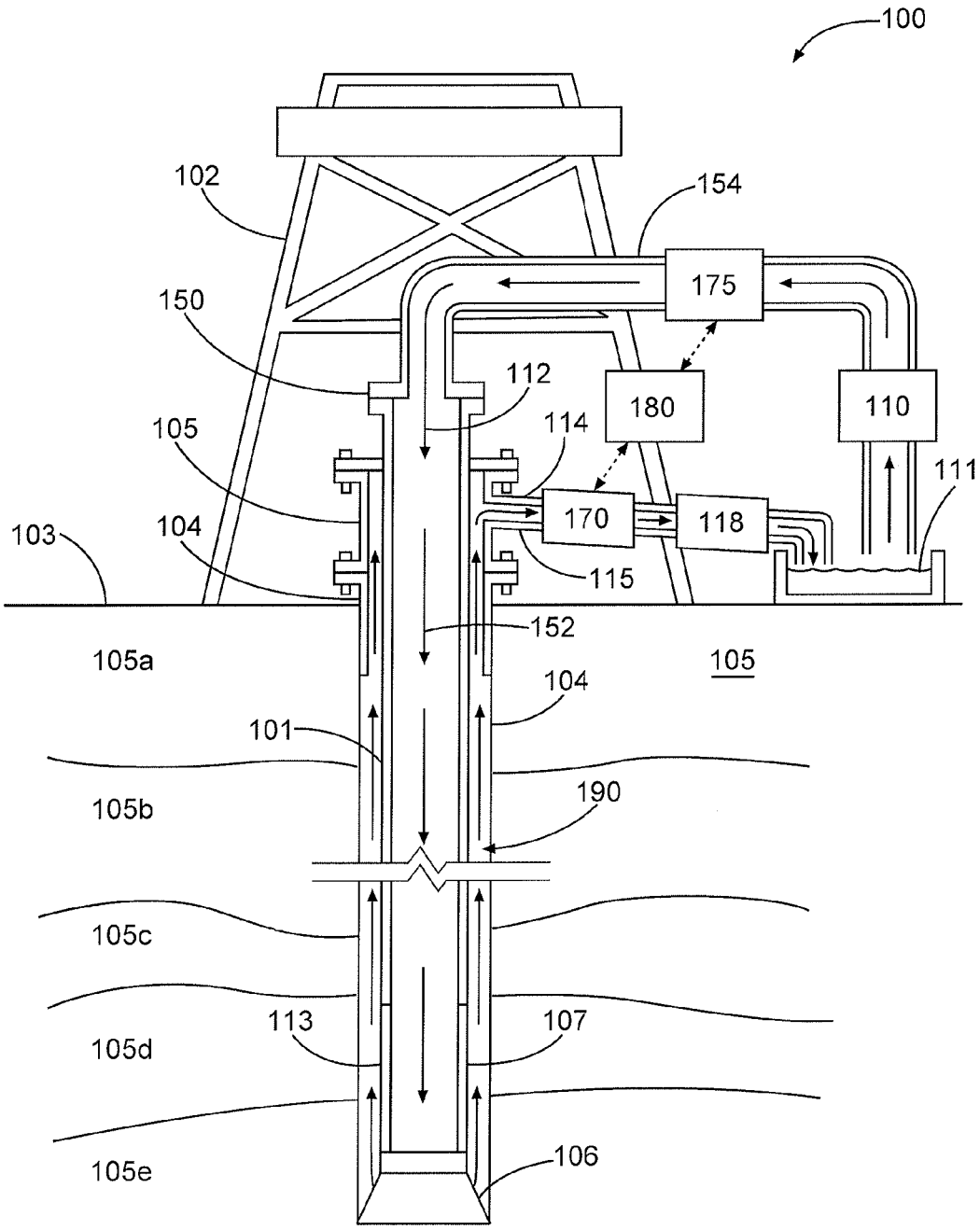
FIG. 1 is a diagram of an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to drilling fluid analysis using time-of-flight mass spectrometry.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include, but are not limited to, target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, stimulation wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing downtime. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections. The indefinite articles "a" or "an," as used herein, are defined herein to mean one or more than one of the elements that it introduces. The terms "gas" or "fluid," as used herein, are not limiting and are used interchangeably to describe a gas, a liquid, a solid, or some combination of a gas, a liquid, and/or a solid.

FIG. 1 is a diagram illustrating an example drilling system 100, according to aspects of the present disclosure. The drilling system 100 comprises a drilling assembly 190 that is suspended from a drilling rig 102 at the surface 103 and disposed in a borehole 104 within a formation 105. The formation 105 may be comprised of at least one rock strata. In the embodiment shown, the formation 105 is comprised of rock strata 105*a-e*, each of which may be made of different rock types with different characteristics. At least some of the strata 105*a-e* may be porous and contain trapped fluids and gasses.

The drilling assembly 190 may comprise a tubular drill string 101 and a drill bit 106 may be coupled to a distal end of the drill string 101. The drill bit 190 may be rotated either by a top drive or kelley mechanism 150 at the surface 103 that rotates the entire drilling assembly 190, or by a downhole motor (not shown) to extend the borehole 104. In the embodiment shown, the drilling assembly 190 further comprises a bottom-hole assembly (BHA) 107 through which the drill bit 104 is indirectly coupled to the drill string 101. The BHA 107 may include a variety of MWD/LWD tools, drill collars, steering systems, downhole motors, etc., depending on the drilling application.

The drill string 101 extends downwardly through a surface tubular 108 into the borehole 104. The surface tubular 108 may be coupled to a wellhead 109. The wellhead 109 may include a portion that extends into the borehole 104. In certain embodiments, the wellhead 109 may be secured within the borehole 104 using cement, and may work with the surface tubular 108 and other surface equipment, such as a blowout preventer (BOP) (not shown), to prevent excess pressures from the formation 105 and borehole 104 from being released at the surface 103.

During drilling operations, a pump 110 located at the surface 103 may pump drilling fluid from a fluid reservoir 111 through the top drive 150, into the inner bore 152 of the drill string 101. The pump 110 may be in fluid communication with the inner bore 152 through at least one fluid conduit or pipe 154 coupled between the pump 110 and the top drive 150. As indicated by arrows 112, the drilling fluid may flow through the interior bore 152 of drill string 101, through the drill bit 106 and into a borehole annulus 113. The borehole annulus 113 is created by the rotation of the drill string 101 and attached drill bit 106 in borehole 104 and is defined as the space between the interior/inner wall or diameter of borehole 104 and the exterior/outer surface or diameter of the drill string 101. The annular space may extend out of the borehole 104, through the wellhead 109 and into the surface tubular 108.

Fluid pumped into the borehole annulus 113 through the drill string 101 flows upwardly through the borehole annulus 113. Surface tubular 108 is in fluid communication with the borehole annulus 113 and the drilling fluid may exit the borehole annulus 113 into the annular space of the surface tubular 108. The surface tubular 108 may have an outlet port 114 coupled to a fluid conduit or pipe 115. The fluid conduit 115 may also be referred to as a fluid return, where drilling fluid pumped downhole through the drill string 101 returns to the surface 103. Specifically, drilling fluid flowing through the borehole annulus 113 may enter the surface tubular 108 and exit through the outlet 114 to the fluid conduit 115. The fluid conduit 115 may provide fluid communication between the borehole annulus 113 and at least one fluid treatment mechanism 118, which may include screens that filter out particulates from the fluid before passing the fluid to the surface reservoir 111.

According to aspects of the present disclosure, the drilling system may comprise at least one fluid analyzer that is in fluid communication with the drilling fluid as it enters the internal bore 152 of the drill string 101 and/or as it exits the borehole 104 after flowing through the borehole annulus 113. In certain embodiments, the fluid analyzer may be in fluid communication with the drilling fluid by being either coupled to or in fluid communication with the interior of one of fluid conduits 115 and 154. In other embodiments, the fluid analyzer may be in fluid communication with the drilling fluid being either coupled to or in fluid communication with a fluid tank, fluid line, possum belly, gumbo box, return line, suction line, stand pipe, or other point at the well head.

The fluid analyzer may comprise a stand-alone machine or mechanism or may comprise integrated functionality of a larger analysis/extraction mechanism. FIG. 1 shows a first fluid analyzer 170 in fluid communication with the fluid conduit 115 between the surface tubular 108 and the fluid treatment mechanism 118. In certain embodiments, the fluid analyzer 170 may comprise at least one probe that is inserted into the fluid conduit 115 to provide fluid communication with the drilling fluid exiting the borehole annulus 113. In other embodiments, the fluid conduit 115 may comprise multiple segments that are connected directly to the fluid analyzer 170, which may partially act as a portion of the fluid conduit 115 and take fluid samples/measurements as needed.

FIG. 1 further shows a second fluid analyzer 175 in fluid communication with the fluid conduit 154 between pump 110 and the top drive 150. In certain embodiments, the fluid analyzer 175 may comprise at least one probe that is inserted into the fluid conduit 154 to provide fluid communication with the drilling fluid entering the internal bore 154 of the drill string 101. In other embodiments, the fluid conduit 154 may comprise multiple segments that are connected directly to the fluid analyzer 175, which may partially act as a portion of the fluid conduit 154 and take fluid samples/measurements as needed. Although two fluid analyzers are shown in FIG. 1, only one fluid analyzer may be used in other embodiments, positioned similarly to either one of the fluid analyzers 170 and 175.

At least some of the strata 105*a-e* may contain trapped fluids that are held under pressure. As the borehole 104 penetrates new strata, some of these fluids may be released into the borehole 104. The released fluids may become suspended or dissolved in the drilling fluid as it exits the drill bit 106 and travels through the borehole annulus 113. Each released fluid may be characterized by its chemical composition, and certain formation strata may be identified by the fluids it contains. As will be described below, the fluid analyzers 170 and 175 may take periodic or continuous samples of the drilling fluid, for example, by pumping, gravity drain or diversion of flow, or other means. The fluid analyzers 170 and 175 may generate corresponding measurements of the samples that may be used to determine the chemical composition of the drilling fluid. This chemical composition may be used to determine the types of fluid that are suspended within the drilling fluid, which can then be used to determined a formation characteristic about the formation 105.

In certain embodiments, the fluid analyzers 170 and 175 may be communicably coupled to an information handling system 180 positioned at the surface 103. The information handling system 180 may receive an output from the fluid analyzers 170 and 175 and/or control the operation of the fluid analyzers 170 and 175, including how often the fluid analyzers 170 and 175 take measurements. In certain embodiments, the information handling system 180 may be dedicated to the fluid analyzers 170 and 175. In other embodiments, the information handling system 180 may receive measurements from a variety of devices in the drilling system 100 and/or control the operation of other devices.

The output of the fluid analyzers 170 and 175 may correspond to measurements taken by the fluid analyzers 170 and 175 of the drilling fluid or of samples of the drilling fluid. In certain embodiments, the information handling system 180 may determine a chemical composition of the drilling fluid using the fluid analyzers 170 and 175, and in particular the outputs from fluid analyzers 170 and 175. The chemical composition of the drilling fluid may comprise the types of chemicals found in the drill fluid and their relative concentrations. The information handling system 180 may determine the chemical composition, for example, by receiving an output from the fluid analyzers 170 and 175, and comparing the output to a first data set corresponding to known chemical compositions. The information handling system 180 may further determine the types of fluid suspended within the drill fluid based on the determined chemical composition.

In certain embodiments, the information handling system 180 may determine a formation characteristic using the determined chemical composition. An example determined chemical composition for a drilling fluid may be 15% chemical/compound A, 20% chemical/compound B, 60% chemical/compound C, and 5% other chemicals/compounds. Example downhole characteristics include, but are not limited to, the type of rock in the formation 105, the presences of hydrocarbons in the formation 105, the production potential for a strata 105*a-e* of the formation 105, and the movement of fluid within a strata 105*a-e*. In certain embodiments, the information handling system 180 may determine the formation characteristic using the determined chemical composition characteristics by comparing the determined chemical composition to a second data set the includes chemical compositions of known subterranean formations. For example, the determined chemical composition may correspond to a drilling fluid with suspended fluid from a shale layer in the formation 105.

Figure 2:
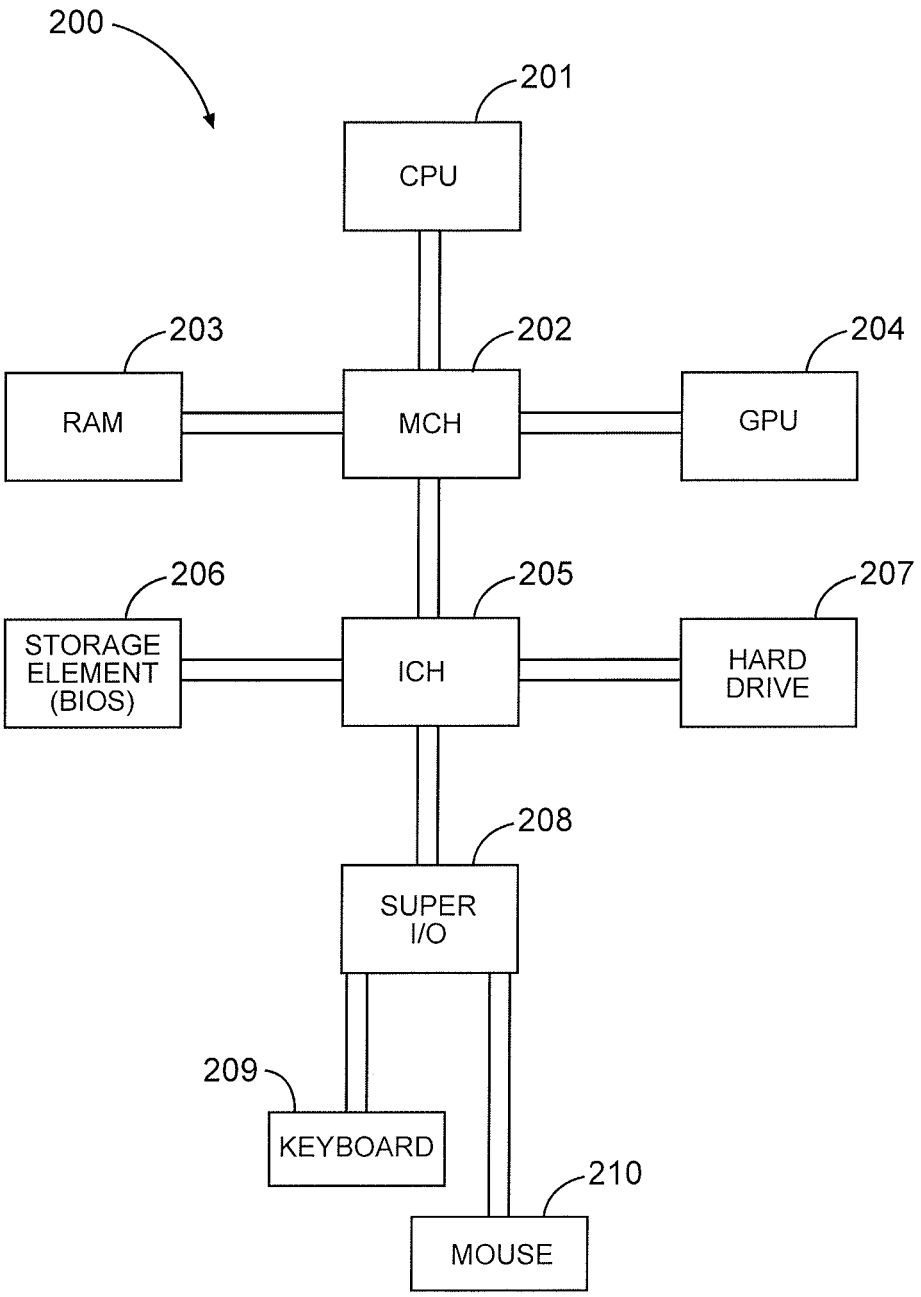
FIG. 2 is a block diagram of an example information handling system, according to aspects of the present disclosure.

FIG. 2 is a block diagram showing an example information handling system 200, according to aspects of the present disclosure. A processor or CPU 201 of the information handling system 200 is communicatively coupled to a memory controller hub or north bridge 202. Memory controller hub 202 may include a memory controller for directing information to or from various system memory components within the information handling system, such as RAM 203, storage element 206, and hard drive 207. The memory controller hub 202 may be coupled to RAM 203 and a graphics processing unit 204. Memory controller hub 202 may also be coupled to an I/O controller hub or south bridge 205. I/O hub 205 is coupled to storage elements of the computer system, including a storage element 206, which may comprise a flash ROM that includes a basic input/output system (BIOS) of the computer system. I/O hub 205 is also coupled to the hard drive 207 of the computer system. I/O hub 205 may also be coupled to a Super I/O chip 208, which is itself coupled to several of the I/O ports of the computer system, including keyboard 209 and mouse 210. In certain embodiments, the Super I/O chip may also be connected to and receive input from a fluid analyzer, similar to fluid analyzers 170 and 175 from FIG. 1.

Figure 3:
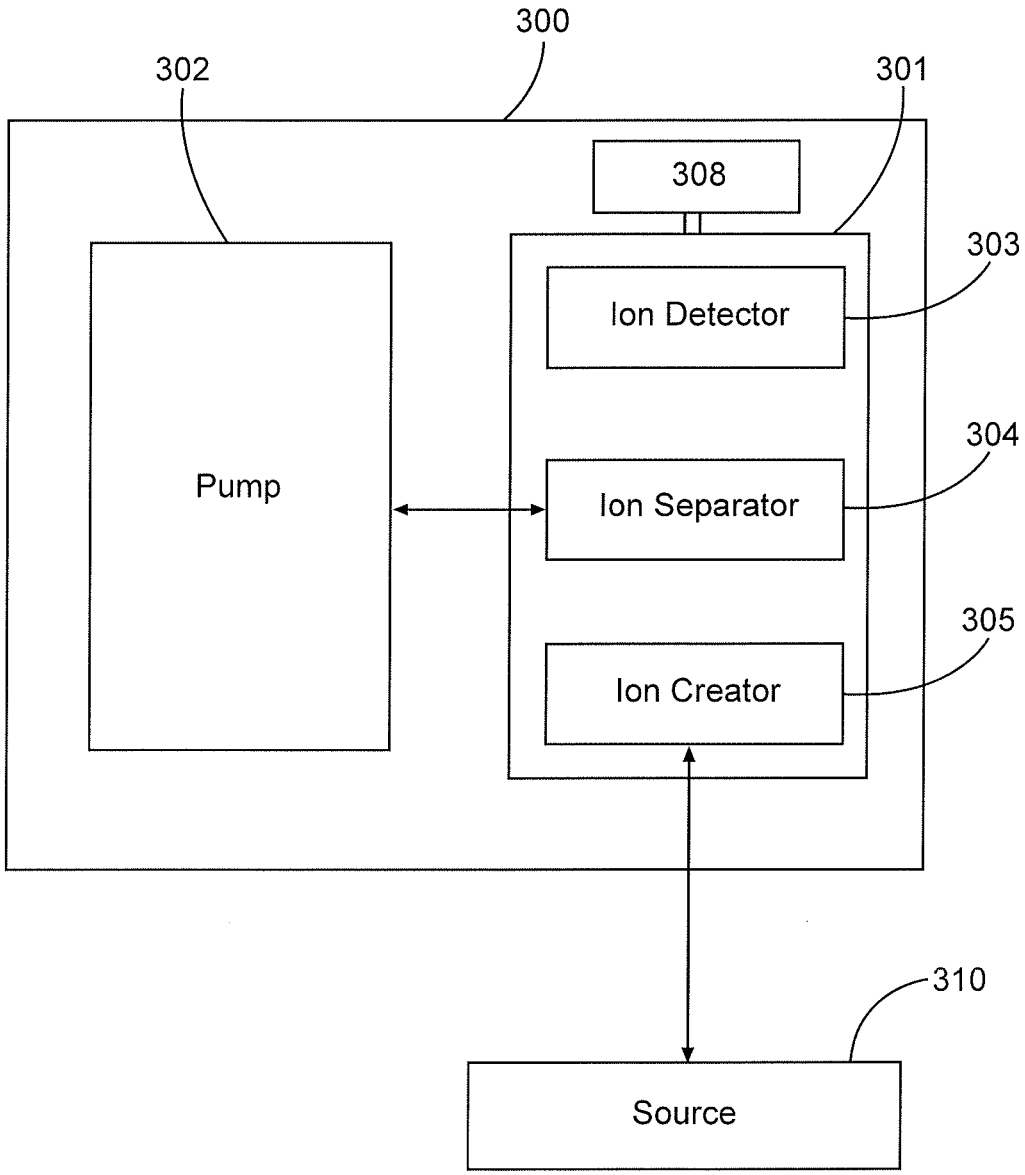
FIG. 3 is a block diagram of an example fluid analyzer, according to aspects of the present disclosure.

According to aspects of the present disclosure, fluid analyzers may comprise a Time-of-Flight Mass Spectrometer (TOF-MS). FIG. 3 is a block diagram illustrating an example fluid analyzer 300, according to aspects of the present disclosure. The fluid analyzer 300 may be in fluid communication with a fluid source 310. The fluid source 310 may comprise drilling fluid as it enters into or exits from the borehole in a drilling system, or gas extracted from the drilling fluid by a gas extractor positioned between the fluid analyzer 300 and the drilling fluid. An example extraction process may include retrieving fluid samples from the drilling system and moving them to an extractor by pump at a controlled volume rate. The sample may be heated or cooled to a specified controlled temperature before entering the gas extractor or when in the extractor. Example heating and cooling mechanisms include a shelltube heat exchanger with single or multiple passes; and thermoelectric, electric, and finned tube heat exchangers that are driven by electricity, gas or liquid. Example gas extractors include continuously stirred vessels, distillation columns, flash columns, separator columns or any other vessel that allows for the separation and expansion of gas from liquid and solids run at a specified pressure or uncontrolled pressure. In certain embodiments, a carrier gas, such as atmospheric or purified gasses, can be introduced into the gas extractor to aide in the movement of the extracted gas. In certain embodiments, the extracted gas may be moved to a TOF-MS 301 within the fluid analyzer 300 by a piston pump, positive displacement pump or other type of pump. The pump may deliver at a continuous or specified interval a gas sample that could be completely composed of extracted gas or composed of a carrier gas mixed with extracted gas.

The fluid analyzer 300 may comprise a TOF-MS 301 and a pump 302. The TOF-MS 301 may comprise an ion creator 305, an ion separator 304, and an ion detector 303. In certain embodiments, the TOF-MS 301 may further comprise a control unit 308 communicably coupled to at least one of the ion creator 305, the ion separator 304, and the ion detector 303. The control unit 308 may comprise an information handling system with at least a processor and a memory device, and may direct commands to and/or receive measurements from at least one of the ion creator 305, the ion separator 304, and the ion detector 303. In certain embodiments, the control unit 308 may comprise or be communicably coupled to an information handling system similar to information handling system unit 180 in FIG. 1. The pump 302 may be coupled to and/or in fluid communication with at least a portion of the TOF-MS 301, and may create a vacuum chamber within the TOF-MS as will be described below. In certain embodiments, the pump 302 may comprise at least one of a roughing pump, a turbomolecular pump, and a molecular diffusion pump. Other ultra-high or high vacuum pumps may be used, as would be appreciated by one of ordinary skill in the art in view of this disclosure.

Figure 4:
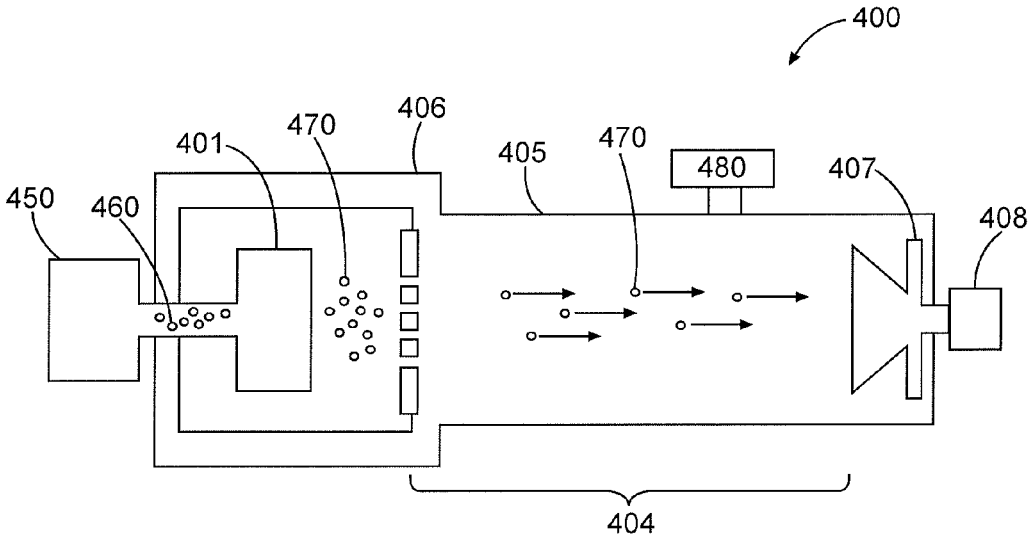
FIG. 4 is a diagram of an example time-of-flight mass spectrometer, according to aspects of the present disclosure.

FIG. 4 is a diagram of an example TOF-MS 400, according aspects of the present disclosure. The TOF-MS 400 may receive molecules 460 from the fluid source 450 at the ion creator 401. The ion creator 401 may then create ions 470 out of the molecules by either adding charge to or removing charge from the molecules. In certain embodiments, the ion creator 401 may create ions out of the molecules using at least one of electron impact ionization, chemical ionization, electrospray ionization, matrix-assisted laser desorption/ionization, inductively coupled plasma, glow discharge, field desorption, fast atom bombardment, thermospray, desorption/ionization on silicon, direct analysis in real time, atmospheric pressure chemical ionization, secondary ion mass spectrometry, spark ionization, and thermal ionization. The above list is not intended to be limiting, and other ionization techniques may be used, as would be appreciated by one of ordinary skill in the art in view of this disclosure.

After the ions 470 are created in the ion creator 401, the ions 470 may be passed into an ion separator 404. The ion separator 404 may separate the ions 470 according to their mass-to-charge ratio. In certain embodiments, the ion separator 404 may comprise, for example, a linear flight tube 405 and a grid plate 406. The grid plate 406 may be coupled to a power source and may generate an electric field. As the ions 470 pass through the grid plate 406/electric field, an equal amount force may be imparted onto each of the ions 470, accelerating the ions 470 into the flight tube 405, toward the ion detector 407. Because the force applied to each ion 470 is the same, the acceleration of each ion 470 and its resulting velocity depends on the mass of the ion. Lighter ions will be accelerated more and travel faster than heavier ions when the same force is applied. Likewise, ions of the same mass will be accelerated at the same rate and travel the same speed. Accordingly, the ions 470 will are effectively separated according to their mass, because the net charge of each ion 470 will be the same.

The accelerated ions 470 will travel within the flight tube 405 until they contact the ion detector 407. The ion detector 407 may generate an output that identifies when the ions 470 contact the ion detector 470. In certain embodiments, the ion detector 407 may generate current or voltage each time an ion 470 contacts the ion detector 407. The output may comprise the resulting electrical signal from the ion detector 470, which includes a series of voltage or current spikes spaced apart in time. The time between the voltage or current spikes in the output signal may correspond to the time between when certain of the ions 470 struck the ion detector 407. The amplitude of the voltage or current spikes may correspond to the number of ions 470 that struck the ion detector 407 at a given time. Example ion detectors include, but are not limited to, secondary emission multipliers, faraday cups, and multichannel plate detectors.

In certain embodiments, the flight tube 405 may comprise a vacuum chamber and a pump 480 may be in fluid communication with the flight tube 405 to generate the vacuum. By removing air from the flight tube 405, the possibility that one of the ions 470 strikes an air molecule is reduced. If the ions 470 strike extraneous molecules while they are traveling within the flight tube 405, they will be deflected, increasing the time it takes from the ions 470 to reach to ion detector 407 (if they do at all) and negatively affecting the accuracy of the output. In certain embodiments, the pump 480 may comprise at least one of a turbomolecular pump and a molecular diffusion pump. The turbomolecular pump and/or the molecular diffusion pump may generate a primary vacuum within the flight tube 405. In certain embodiments, the turbomolecular pump and/or the molecular diffusion pump may be connected in series with a roughing pump that may increase or improve the vacuum within the flight tube 405.

In certain embodiments, the output of the ion detector 407 may comprise the output of the TOF-MS 400. In certain other embodiments, though, the output of the ion detector 407 may be processed before it leaves the TOF-MS 400. For example, an information handling system 408 may be coupled to the ion detector 407 and may convert the output of the ion detector 407 into mass spectra. In certain embodiments, the information handling system 408 may also be coupled to the ion generator 401 and the grid plate 406. The information handling system 408 may receive an indication of the time at which the ions 470 are accelerated and may correlate the time to the time signature of the output of the ion detector 407, and particularly the time at which the various voltage or current spikes occurred. By correlating the time of acceleration with the time when the ions 470 contacted the ion detector 407, the information handling system may determine the mass of the ions 470 that contacted the ion detector 407 at a given time, because the strength of the accelerating force (the electric field) and the distance the ions 370 traveled (the length of the flight tube 405) are known. The resulting output may comprise mass spectra of the ions 370.

Figure 5:
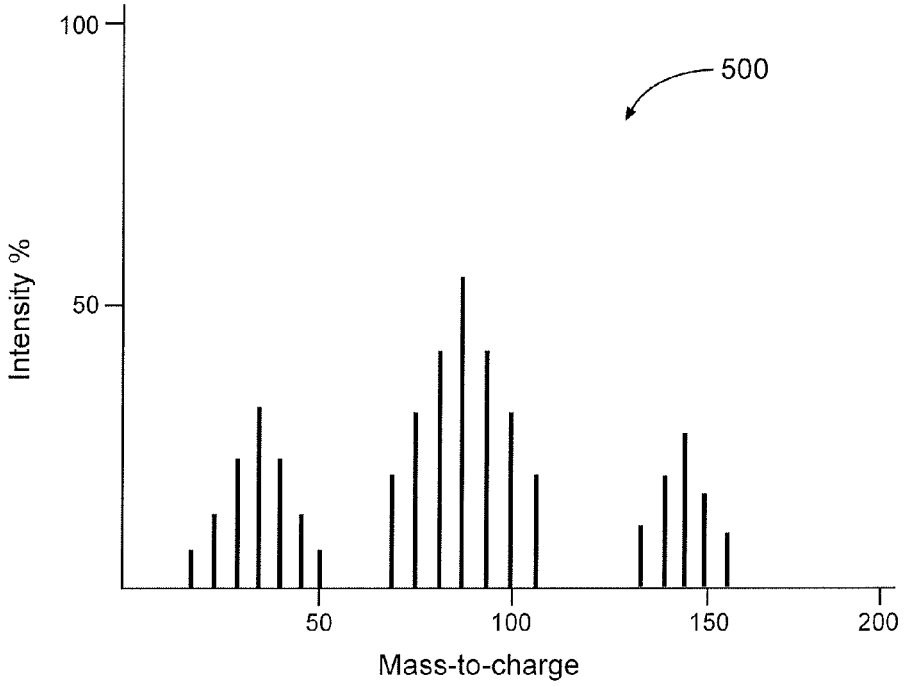
FIG. 5 is a chart of an example mass spectra, according to aspects of the present disclosure.

FIG. 5 illustrates example mass spectra 500, with the mass-to-charge ratio of the received ions on the x-axis, and the amount of ions of a particular mass-to-charge ratio as a percentage of the ions received on the y-axis. The mass-to-charge ratio on the x-axis may correspond to the masses of various chemicals and compounds by their atomic mass units (AMU). As can be seen, the mass spectra may identify chemicals with AMUs above 140. In certain embodiments, the mass by AMU of the various ions may be extracted from the mass spectra 500, and the type of each ion may be determined by comparing its AMU to the known AMU of any chemical on the periodic table. The mass may be extracted, for example, using one or more deconvolution algorithms that would be appreciated by one of ordinary skill in view of this disclosure. Once the chemical composition of the drilling fluid is known, the fluids suspended within the drilling fluid may be determined by excluding those chemicals known to have been in the drilling fluid before the drilling fluid was introduced downhole. Additionally, once the types of fluid suspended within the drilling fluid are known, those fluids and corresponding chemical compositions may be correlated to a data set corresponding to known chemical compositions of subterranean formations, allowing for formation characteristics about the subterranean formation to be determined.

Figure 6:
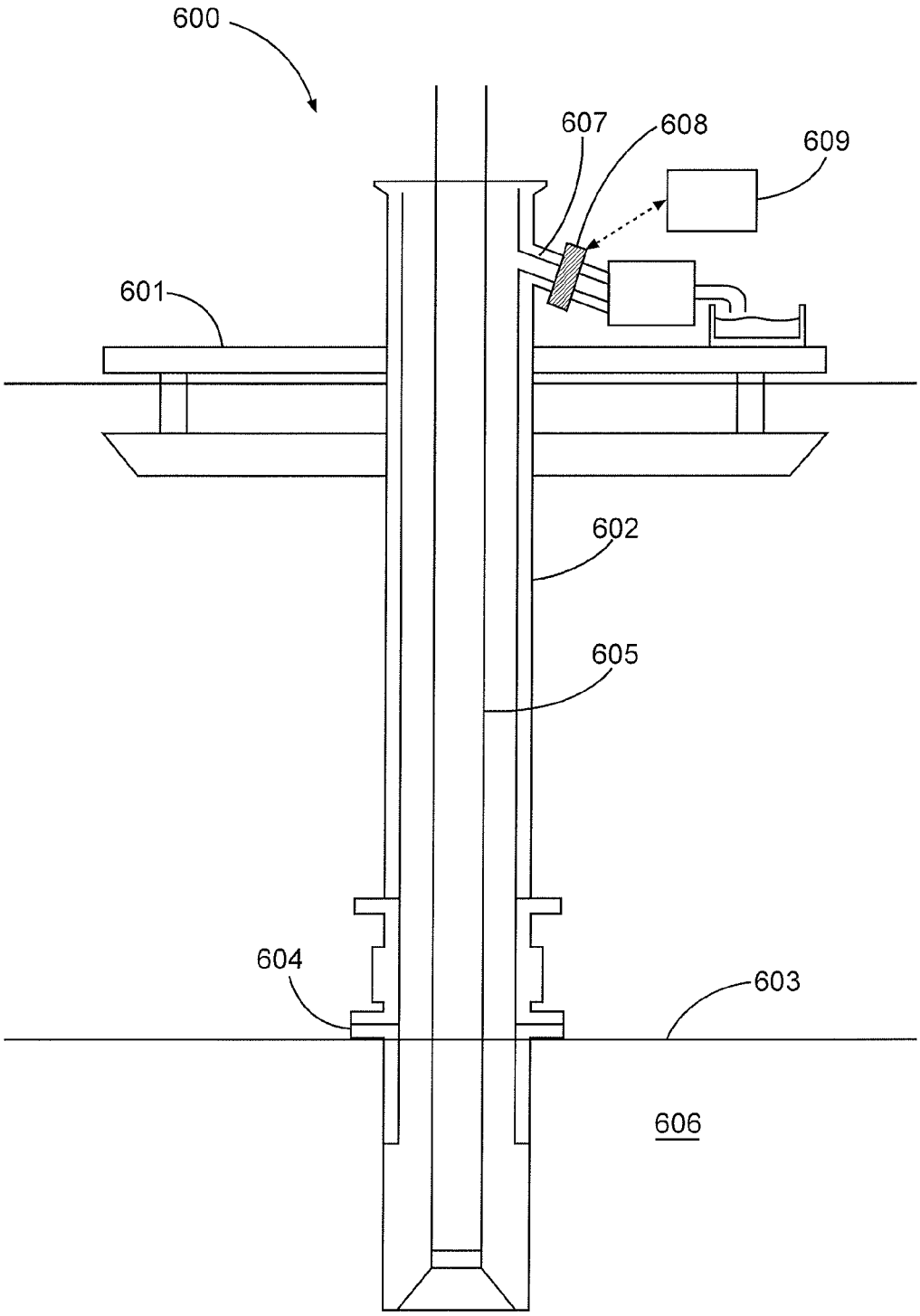
FIG. 6 is a diagram of an example offshore drilling system, according to aspects of the present disclosure.

Although the fluid analyzer/TOF-MS has been described herein in the context of a conventional drilling assembly positioned at the surface, the fluid analyzer/TOF-MS may similarly be used with different drilling assemblies (e.g., wirelines, slickline, etc.) in different locations. FIG. 6 is a diagram of an offshore drilling system 600, according to aspects of the present disclosure. As can be seen, portions of the drilling system 600 may be positioned on a floating platform 601. A tubular 602 may extend from the platform 601 to the sea bed 603, where the well head 604 is located. A drill string 605 may be positioned within the tubular 602, and may be rotated to penetrate the formation 606. Drilling fluid may be circulated downhole within the drill string 605 and return to the surface in an annulus between the drill string 605 and the tubular 602. A proximal portion of the tubular 602 may comprise a fluid conduit 607 coupled thereto. The fluid conduit 607 may function as a fluid return, and a fluid analyzer with a TOF-MS 608, according to aspects of the present disclosure, may be coupled to the fluid conduit 607 and/or in fluid communication with a drilling fluid within the fluid conduit 607. Likewise, the fluid analyzer with a TOF-MS 608 may be communicable coupled to an information handling system 609 positioned on the platform 601.

Figure 7:
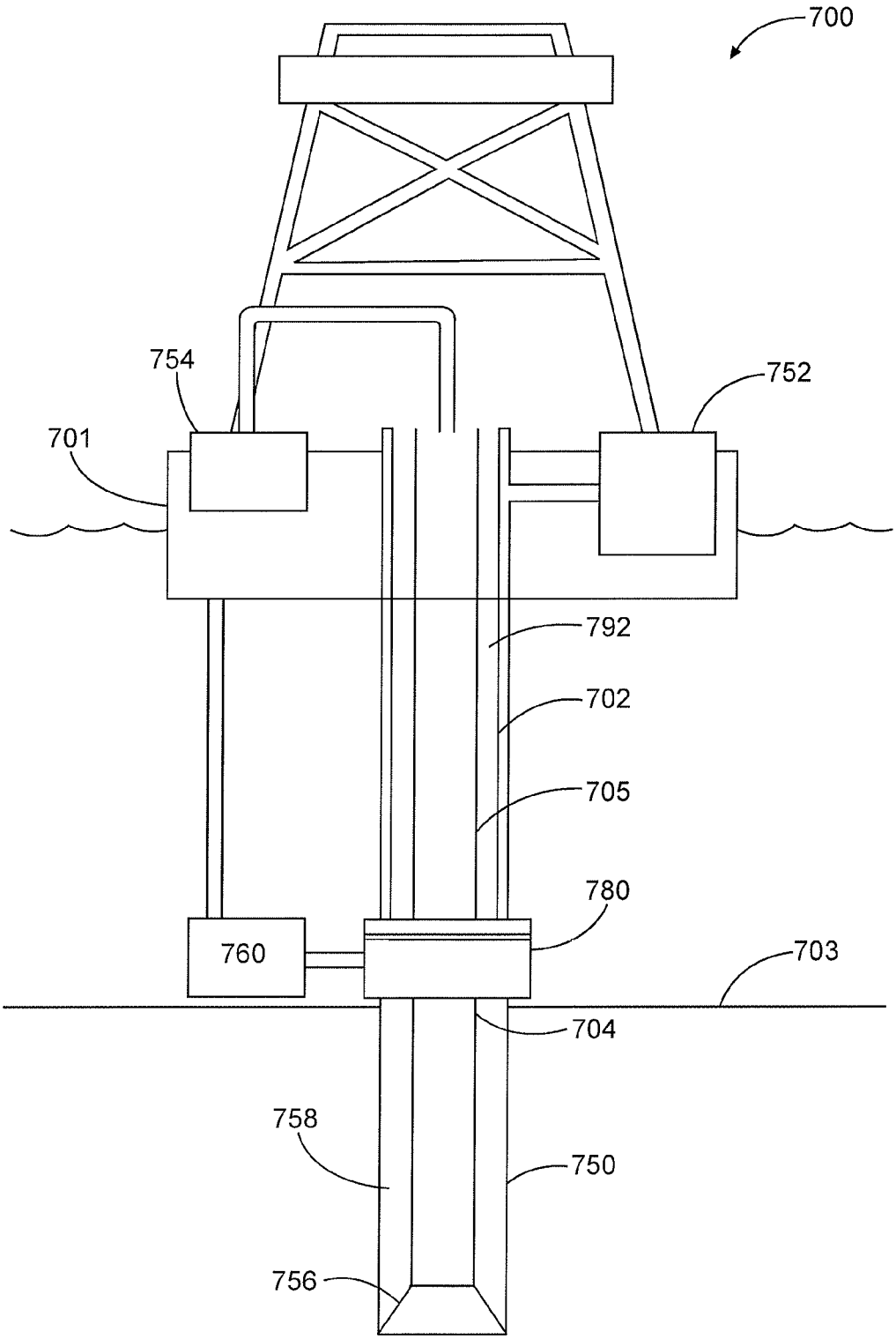
FIG. 7 is a diagram of an example offshore drilling system, according to aspects of the present disclosure.

FIG. 7 is a diagram of a dual gradient offshore drilling system, according to aspects of the present disclosure. As can be seen, portions of the drilling system 700 may be positioned on a floating boat or platform 701. A riser 702 may extend from the platform 701 to the sea bed 703, where the well head 704 is located. A drill string 705 may be positioned within the riser 702 and a borehole 750 within the formation 706. The drill string 705 may pass through a sealed barrier 780 between the riser 702 and the borehole 705. The annulus 792 surrounding the drill string 705 within the riser 702 may be filled with sea water, and a first pump 752 located at the surface may circulate sea water within the riser 702. A second pump 754 positioned at the platform 701 may pump drilling fluid through the drill string 705. Once the drilling fluid exits the drill bit 756 into annulus 758, a third pump 760, located underwater, may pump the drilling fluid to the platform 701. A TOF-MS may be incorporated at various locations within the system 700, including within pumps 754 and 760, in fluid communication with fluid conduits between pumps 754 and 760, or in fluid communication with fluid conduits between the pumps 754 and 760 and the drill string 705.

According to aspects of the present disclosure, an example method for analyzing drilling fluid used in a drilling operation within a subterranean formation may comprise placing a TOF-MS in fluid communication with a drilling fluid. The drilling fluid may be flowing through a fluid conduit coupled to a drilling assembly. A chemical composition of the drilling fluid may be determined using the TOF-MS. And a formation characteristic may be determined using the determined chemical composition.

In certain embodiments, the TOF-MS may comprise a linear flight tube. And an example TOF-MS may create ions from molecules of the drilling fluid using at least one of electron impact ionization, chemical ionization, electrospray ionization, matrix-assisted laser desorption/ionization, inductively coupled plasma, glow discharge, field desorption, fast atom bombardment, thermospray, desorption/ionization on silicon, direct analysis in real time, atmospheric pressure chemical ionization, secondary ion mass spectrometry, spark ionization, and thermal ionization. Example TOF-MSs may comprise at least one of a secondary emission multiplier, a faraday cup, and a multichannel plate detector. In certain embodiments, at least one of a roughing pump, a turbomolecular pump, and a molecular diffusion pump may be coupled to a linear flight tube of the TOF-MS.

In certain embodiments, determining the chemical composition of the drilling fluid using the TOF-MS may comprise receiving an output of the TOF-MS at an information handling system coupled to the TOF-MS; and comparing the output of the TOF-MS to a first data set corresponding to known chemical compositions. Similarly, determining the formation characteristic using the determined chemical composition may comprise comparing the determined chemical composition to a second data set corresponding to known chemical compositions of subterranean formations. The formation characteristic may comprises at least one of a type of rock in the formation, the presence of hydrocarbons in the formation, the production potential for a strata of the formation, and the movement of fluid within the strata.

An example apparatus for analyzing drilling fluid used in a drilling operation within a subterranean formation may comprise a TOF-MS in fluid communication with a drilling fluid. The drilling fluid may be flowing through a fluid conduit coupled to a drilling assembly. The apparatus may further include an information handling system communicably coupled to the TOF-MS. The information handling system may comprise a processor and a memory device coupled to the processor, and the memory device may contain a set of instructions. The set of instruction may, when executed by the processor, cause the processor to receive an output of the TOF-MS, determine a chemical composition of the drilling fluid using the output, and determine a formation characteristic using the determined chemical composition.

In certain embodiments, the TOF-MS may comprise a linear flight tube. The TOF-MS may create ions from molecules of the drilling fluid using at least one of electron impact ionization, chemical ionization, electrospray ionization, matrix-assisted laser desorption/ionization, inductively coupled plasma, glow discharge, field desorption, fast atom bombardment, thermospray, desorption/ionization on silicon, direct analysis in real time, atmospheric pressure chemical ionization, secondary ion mass spectrometry, spark ionization, and thermal ionization. The TOF-MS may comprise at least one of a secondary emission multiplier, a faraday cup, and a multichannel plate detector. Additionally, at least one of a roughing pump, a turbomolecular pump, and a molecular diffusion pump is coupled to a linear flight tube of the TOF-MS.

In certain embodiments, the set of instructions that cause the processor to determine the chemical composition of the drilling fluid using the output further may further cause the processor to compare the output to a first data set corresponding to known chemical compositions. Likewise, the set of instructions that cause the processor to determine the formation characteristic using the determined chemical composition may further cause the processor to compare the determined chemical composition to a second data set containing chemical compositions of known subterranean formations. In certain embodiments, the formation characteristic may comprise at least one of a type of rock in the formation, the presence of hydrocarbons in the formation, the production potential for a strata of the formation, and the movement of fluid the strata.

An example system for analyzing drilling fluid used in a drilling operation within a subterranean formation may comprise a drilling assembly at least partially disposed within the subterranean formation. A fluid conduit may be in fluid communication with the drilling assembly, and TOF-MS may be in fluid communication with an interior of the fluid conduit. The system may further include an information handling system communicably coupled to the TOF-MS. The information handling system may comprise a processor and a memory device coupled to the processor, and the memory device may contain a set of instructions that, when executed by the processor, cause the processor to receive an output of the TOF-MS, determine a chemical composition of a drilling fluid within the fluid conduit using the output, and determine a formation characteristic using the determined chemical composition.

In certain embodiments, the TOF-MS may comprise a linear flight tube. The TOF-MS may create ions from molecules of the drilling fluid within the fluid conduit using at least one of electron impact ionization, chemical ionization, electrospray ionization, matrix-assisted laser desorption/ionization, inductively coupled plasma, glow discharge, field desorption, fast atom bombardment, thermospray, desorption/ionization on silicon, direct analysis in real time, atmospheric pressure chemical ionization, secondary ion mass spectrometry, spark ionization, and thermal ionization. In certain embodiments, the TOF-MS may comprise at least one of a secondary emission multiplier, a faraday cup, and a multichannel plate detector; and at least one of a roughing pump, a turbomolecular pump, and a molecular diffusion pump may be coupled to a linear flight tube of the TOF-MS.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method for analyzing drilling fluid used in a drilling operation within a subterranean formation, comprising:

flowing a drilling fluid through a fluid conduit coupled to a drilling assembly;

placing a Time-of-Flight Mass Spectrometer (TOF-MS) in fluid communication with the drilling fluid, wherein the TOF-MS comprises a linear flight tube and at least one of a secondary emission multiplier, a faraday cup, and a multichannel plate detector;

coupling at least one of a roughing pump, a turbomolecular pump, and a molecular diffusion pump to the linear flight tube;

determining a chemical composition of the drilling fluid using the TOF-MS; and determining a formation characteristic using the determined chemical composition.

2. The method of claim 1, wherein the TOF-MS creates ions from molecules of the drilling fluid using at least one of electron impact ionization, chemical ionization, electrospray ionization, matrix-assisted laser desorption/ionization, inductively coupled plasma, glow discharge, field desorption, fast atom bombardment, thermospray, desorption/ionization on silicon, direct analysis in real time, atmospheric pressure chemical ionization, secondary ion mass spectrometry, spark ionization, and thermal ionization.

3. The method of claim 1, wherein determining the chemical composition of the drilling fluid using the TOF-MS comprises receiving an output of the TOF-MS at an information handling system coupled to the TOF-MS; and comparing the output of the TOF-MS to a first data set corresponding to known chemical compositions.

4. The method of claim 1, wherein determining the formation characteristic using the determined chemical composition comprises comparing the determined chemical composition to a second data set corresponding to known chemical compositions of subterranean formations.

5. The method of claim 1, wherein the formation characteristic comprises at least one of a type of rock in the formation, the presence of hydrocarbons in the formation, the production potential for a strata of the formation, and the movement of fluid within the strata.

6. The method of claim 1 wherein the TOF-MS further comprises a grid plate coupled to a power source.

7. The method of claim 1 further comprising:

extracting gas from the drilling fluid using a gas extractor;

placing the TOF-MS in fluid communication with the extracted gas; and determining a chemical composition of the extracted gas using the TOF-MS.

8. An apparatus for analyzing drilling fluid used in a drilling operation within a subterranean formation, comprising:

a Time-of-Flight Mass Spectrometer (TOF-MS) in fluid communication with a drilling fluid, wherein the drilling fluid is flowing through a fluid conduit coupled to a drilling assembly, wherein the TOF-MS comprises a linear flight tube and at least one of a secondary emission multiplier, a faraday cup, and a multichannel plate detector, and wherein at least one of a roughing pump, a turbomolecular pump, and a molecular diffusion pump is coupled to the linear flight tube; and an information handling system communicably coupled to the TOF-MS, wherein the information handling system comprises a processor and a memory device coupled to the processor, and the memory device contains a set of instructions that, when executed by the processor, cause the processor to receive an output of the TOF-MS;

determine a chemical composition of the drilling fluid using the output; and determine a formation characteristic using the determined chemical composition.

9. The apparatus of claim 8, wherein the TOF-MS creates ions from molecules of the drilling fluid using at least one of electron impact ionization, chemical ionization, electrospray ionization, matrix-assisted laser desorption/ionization, inductively coupled plasma, glow discharge, field desorption, fast atom bombardment, thermospray, desorption/ionization on silicon, direct analysis in real time, atmospheric pressure chemical ionization, secondary ion mass spectrometry, spark ionization, and thermal ionization.

10. The apparatus of claim 8, wherein the set of instructions that cause the processor to determine the chemical composition of the drilling fluid using the output further cause the processor to compare the output to a first data set corresponding to known chemical compositions.

11. The apparatus of claim 8, wherein the set of instructions that cause the processor to determine the formation characteristic using the determined chemical composition further cause the processor to compare the determined chemical composition to a second data set containing chemical compositions of known subterranean formations.

12. The apparatus of claim 8, wherein the formation characteristic comprises at least one of a type of rock in the formation, the presence of hydrocarbons in the formation, the production potential for a strata of the formation, and the movement of fluid within the strata.

13. The apparatus of claim 8 wherein the TOF-MS further comprises a grid plate coupled to a power source.

14. The apparatus of claim 8 further comprising:

a gas extractor operable to extract gas from the drilling fluid, wherein the extracted gas is in fluid communication with the TOF-MS; and wherein the memory device further contains a set of instructions that, when executed by the processor, cause the processor to receive an output of the TOF-MS; and determine a chemical composition of the extracted gas using the output.

15. A system for analyzing drilling fluid used in a drilling operation within a subterranean formation, comprising:

a drilling assembly at least partially disposed within the subterranean formation;

a fluid conduit in fluid communication with the drilling assembly;

a Time-of-Flight Mass Spectrometer (TOF-MS) in fluid communication with an interior of the fluid conduit, wherein the TOF-MS comprises a linear flight tube and at least one of a secondary emission multiplier, a faraday cup, and a multichannel plate detector, and wherein at least one of a roughing pump, a turbomolecular pump, and a molecular diffusion pump is coupled to the linear flight tube; and an information handling system communicably coupled to the TOF-MS, wherein the information handling system comprises a processor and a memory device coupled to the processor, and the memory device contains a set of instructions that, when executed by the processor, cause the processor to receive an output of the TOF-MS;

determine a chemical composition of a drilling fluid within the fluid conduit using the output; and determine a formation characteristic using the determined chemical composition.

16. The system of claim 15, wherein the TOF-MS creates ions from molecules of the drilling fluid within the fluid conduit using at least one of electron impact ionization, chemical ionization, electrospray ionization, matrix-assisted laser desorption/ionization, inductively coupled plasma, glow discharge, field desorption, fast atom bombardment, thermospray, desorption/ionization on silicon, direct analysis in real time, atmospheric pressure chemical ionization, secondary ion mass spectrometry, spark ionization, and thermal ionization.

17. The system of claim 15, wherein the TOF-MS further comprises a grid plate coupled to a power source.

18. The system of claim 15 further comprising:

a gas extractor operable to extract gas from the drilling fluid, wherein the extracted gas is in fluid communication with the TOF-MS; and wherein the memory device further contains a set of instructions that, when executed by the processor, cause the processor to receive an output of the TOF-MS;

determine a chemical composition of the extracted gas using the output.

* * * * *